US005945901A

United States Patent [19]

Coleman, Jr. et al.

[11] Patent Number: 5,945,901

[45] **Date of Patent: *Aug. 31, 1999**

[54] MAGNETIC HEAD FOR MAGNETIC PICK-UP TOOL

[75] Inventors: Edward S. Coleman, Jr., Ridgefield, Conn.; Stanley Stromski, Riverhead, N.Y.

[73] Assignee: Ullman Devices Corporation, Ridgefield, Conn.

[ * ] Notice: This patent is subject to a terminal disclaimer.

[21] Appl. No.: 08/912,857

[22] Filed: Aug. 18, 1997

Related U.S. Application Data

[63] Continuation-in-part of application No. 08/796,015, Feb. 5, 1997.

[51] Int. Cl.[6] ..... H01F 7/20

[52] U.S. Cl. ..... 335/285; 81/24; 335/298

[58] Field of Search ..... 335/285–306; 294/65.5; 81/24

[56] References Cited

U.S. PATENT DOCUMENTS

| | | | |
|---|---|---|---|
| D. 276,690 | 12/1984 | Hamatani | D8/14 |
| D. 334,519 | 4/1993 | Arnold | D8/51 |
| D. 342,428 | 12/1993 | Olszak | D8/14 |
| D. 376,089 | 12/1996 | Allen | D8/80 |
| D. 378,337 | 3/1997 | Reynolds et al. | D8/14 |
| 2,218,825 | 10/1940 | Guillou . | |
| 2,372,930 | 4/1945 | Bovee . | |
| 2,428,864 | 10/1947 | Boyd . | |
| 2,471,764 | 5/1949 | Miller . | |
| 2,517,325 | 8/1950 | Lamb . | |
| 2,547,990 | 4/1951 | Willms . | |
| 2,637,590 | 5/1953 | Ortloff . | |
| 2,683,618 | 7/1954 | Long . | |
| 2,732,243 | 1/1956 | Mount . | |
| 2,778,669 | 1/1957 | Goodwin . | |
| 2,790,116 | 4/1957 | Kirby . | |
| 2,830,663 | 4/1958 | Kirby . | |
| 2,830,664 | 4/1958 | Kirby . | |
| 2,853,331 | 9/1958 | Teetor . | |
| 2,915,681 | 1/1959 | Troy . | |
| 2,947,563 | 8/1960 | Stitt . | |
| 2,976,075 | 3/1961 | Budreck . | |
| 2,993,723 | 7/1961 | Twachtman et al. . | |
| 3,041,697 | 7/1962 | Budreck | 335/285 |
| 3,086,268 | 4/1963 | Chaffin, Jr. | 24/303 |
| 3,169,791 | 2/1965 | Twachtman . | |
| 3,223,898 | 12/1965 | Bey . | |
| 3,253,194 | 5/1966 | Parker . | |
| 3,297,352 | 1/1967 | Larrison et al. . | |
| 3,384,408 | 5/1968 | Furzey . | |
| 3,503,645 | 3/1970 | Huddy . | |
| 3,582,123 | 6/1971 | Kyser . | |
| 3,646,492 | 2/1972 | Westermann . | |
| 3,789,336 | 1/1974 | Gordin . | |
| 4,059,155 | 11/1977 | Greer | 294/65.5 |
| 4,105,239 | 8/1978 | Akczinski, Sr. | 294/65.5 |
| 4,178,029 | 12/1979 | Lapan | 294/65.5 |
| 4,554,703 | 11/1985 | Matuki | 15/424 |
| 4,575,143 | 3/1986 | Nast | 294/65.5 |

(List continued on next page.)

FOREIGN PATENT DOCUMENTS

| | | |
|---|---|---|
| 175645 | 7/1953 | Austria . |

*Primary Examiner*—Michael L. Gellner
*Assistant Examiner*—Raymond Barrera

[57] ABSTRACT

A magnet head for a magnetic pick-up tool includes a magnet having a pick-up surface and a sleeve member having an open end and being slidably positioned over the magnet with the pick-up surface exposed through the open end, the sleeve member being made of a material acted upon by the magnet such that the magnet exerts a force upon the sleeve for maintaining the sleeve in a rest position wherein the open end extends beyond the pick-up surface, wherein the sleeve is slidable in a direction away from the pick-up surface and against the force to a withdrawn with respect to the magnet. A magnetic pick-up tool including a magnet head is also disclosed.

30 Claims, 2 Drawing Sheets

U.S. PATENT DOCUMENTS

| | | | |
|---|---|---|---|
| 4,802,702 | 2/1989 | Bownds | 294/65.5 |
| 4,813,729 | 3/1989 | Speckhart | 294/65.5 |
| 4,850,133 | 7/1989 | Burzdak et al. | 43/196 |
| 4,943,098 | 7/1990 | Aoyama | 294/65.5 |
| 5,062,672 | 11/1991 | Harris | 294/65.5 |
| 5,099,539 | 3/1992 | Forester | 15/143 B |
| 5,169,193 | 12/1992 | Stelmach | 294/65.5 |
| 5,249,832 | 10/1993 | Leonardz | 294/65.5 |
| 5,261,714 | 11/1993 | Slusar et al. | 294/65.5 |
| 5,265,887 | 11/1993 | Stelmach | 294/65.5 |
| 5,288,119 | 2/1994 | Crawford, Jr. et al. | 294/65.5 |
| 5,314,221 | 5/1994 | Hammer | 294/19.1 |
| 5,348,359 | 9/1994 | Boozer | 294/65.5 |
| 5,360,247 | 11/1994 | Vachter | 294/1.4 |
| 5,381,319 | 1/1995 | Shiao | 362/120 |
| 5,395,148 | 3/1995 | Jameson et al. | 294/65.5 |
| 5,429,402 | 7/1995 | Kennedy | 294/65.5 |
| 5,433,492 | 7/1995 | Glossop, Jr. | 294/65.5 |
| 5,472,253 | 12/1995 | Resor | 294/65.5 |

MAGNETIC HEAD FOR MAGNETIC PICK-UP TOOL

CROSS-REFERENCE TO RELATED APPLICATION

This application is a continuation-in-part of U.S. patent application Ser. No. 08/796,015, filed Feb. 5, 1997.

BACKGROUND OF THE INVENTION

The invention relates to a magnetic head for a magnetic pick-up tool, and a magnetic pick-up tool including same.

Magnetic pick-up tools are used widely for retrieving ferrous metallic or other magnetically acted upon materials from difficult-to-reach locations. Such tools are used, for example, by mechanics working on automobiles, welders, technicians, machinists, fishermen, toolmakers, hobbyists and the like.

A common problem encountered with conventional pick-up tools is that the magnet used for retrieving desired objects has attraction not only upon a leading or pick-up surface, but on side surfaces as well. Thus, when reaching through other ferrous metallic objects, the magnet has a tendency to attract or deflect toward an undesired ferrous or other magnetically attracted surface or object.

A further problem experienced in the art is the need to provide a magnet which has significant lifting power in a device which is simple and efficient to manufacture, and which is compact and convenient to use.

In light of the foregoing, it is clear that the need remains for a magnetic head for a magnetic pick-up tool device which has good lifting power and which has reduced or eliminated tendency to attract toward ferrous metal or other magnetically attracted objects positioned radially or to the side of the magnet.

It is therefore the primary object of the present invention to provide a magnetic head for a magnetic pick-up tool wherein side attractive forces of the magnet are substantially reduced or eliminated.

It is a further object of the present invention to provide a magnetic head for a magnetic pick-up tool wherein the effective lifting power of a magnet incorporated therein is increased.

It is still another object of the present invention to provide a magnetic pick-up tool incorporating the magnetic head of the present invention which is simple and inexpensive to manufacture and easy to use.

Other objects and advantages of the present invention will appear hereinbelow.

SUMMARY OF THE INVENTION

In accordance with the present invention, the foregoing objects and advantages are readily attained.

According to the invention, a magnetic head for a magnetic pick-up tool is provided which comprises: a magnet having a pick-up surface; and a sleeve member having an open end and being slidably positioned over said magnet, said sleeve member comprising a material acted upon by said magnet such that said magnet exerts a force upon said sleeve for maintaining said sleeve in a rest position wherein said open end extends beyond said pick-up surface, wherein said sleeve is slidable in a direction away from said pick-up surface and against said force to a withdrawn position with respect to said magnet.

In further accordance with the invention, a magnetic pick-up tool is provided which comprises: a handle member; and a magnetic head attached to said member and comprising a magnet having a pick-up surface and a sleeve member having an open end and being slidably positioned over said magnet, said sleeve member comprising a material acted upon by said magnet such that said magnet exerts a force upon said sleeve for maintaining said sleeve in a rest position wherein said open end extends beyond said pick-up surface, wherein said sleeve is slidable in a direction away from said pick-up surface and against said force to a withdrawn with respect to said magnet.

BRIEF DESCRIPTION OF THE DRAWINGS

A detailed description of preferred embodiments of the invention follows, with reference to the attached drawings, wherein.

DETAILED DESCRIPTION

The invention relates to a magnetic head for a magnetic pick-up tool which serves to reduce or eliminate side pull of the magnet, and further to enhance the pick-up force at the pick-up surface of the magnet, all advantageously and as desired in accordance with the present invention.

Figure 1:
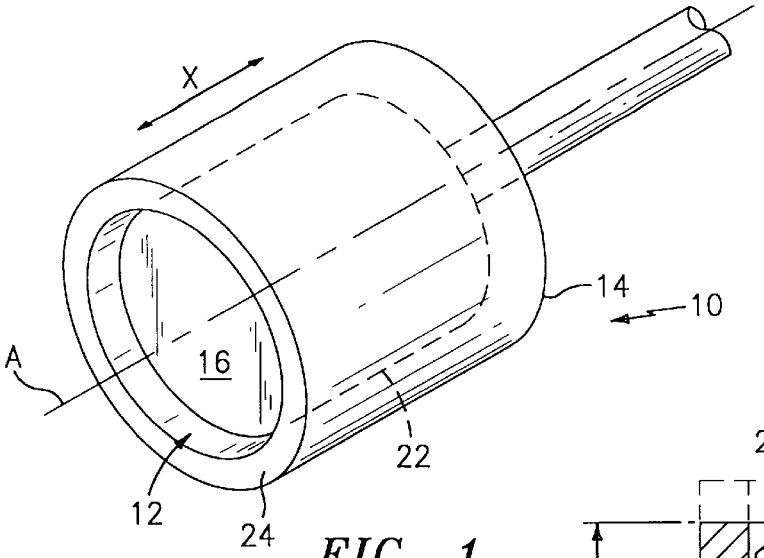
FIG. 1 is a perspective view of a magnetic head in accordance with the present invention.

Referring to the drawings, FIG. 1 shows a magnetic head generally referred to by reference numeral 10 and including a magnet 12 having a longitudinal axis A and a sleeve member 14 slidably positioned over magnet 12 and slidable in a direction along axis A as will be further discussed below.

Magnet 12 may preferably be a substantially cylindrical magnet as shown, or may have any other suitable shape such as, for example, square, rectangular, or partially circular, if desired. Magnet 12 preferably has a pick-up surface 16, and has a pole corresponding with pick-up surface 16 for attracting and holding ferrous or other magnetically attracted objects to pick-up surface 16.

Sleeve member 14 is preferably provided of a material which is acted upon by magnet 12, preferably a ferrous or other magnetically attracted material or other material acting in a magnetic field as or like iron, which material will be referred to herein as ferromagnetic material. Various grades of steel are suitable, and a low carbon or very low carbon steel or other soft steel is preferred and is effective at re-directing flux from magnet 12. Still referring to FIG. 1, sleeve member 14 preferably has a length 18 in the direction of axis A which is longer than a corresponding length 20 of magnet 12, also in the direction of axis A.

In accordance with the invention, sleeve member 14 is acted upon by magnet 12, and a force is exerted by magnet 12 upon sleeve 14, so as to bias sleeve 14 toward a rest position wherein sleeve 14 is substantially centered or magnetically balanced along axis A with respect to magnet 12. In this position, which is illustrated in FIG. 1, sleeve member 14 extends beyond magnet 12, at least beyond pick-up surface 16 of magnet 12, and preferably beyond each edge of magnet 12 as shown (see also FIG. 2). Sleeve 14 can be biased from the rest position rearwardly and away from pick-up surface 16 against the magnetic force of magnet 12 so as to allow objects to be picked up using pick-up surface 16 as described below. Magnet 12 serves to return sleeve 14 to the rest position after sleeve 14 is released or the object retrieved is removed from pick-up surface 16 as desired in accordance with the invention.

Magnet 12 normally has side or radial flux, which would undesirably attract ferrous or magnetically attractable objects to side surfaces 22 of magnet 12. According to the invention, sleeve 14 serves to absorb and redirect radial flux from magnet 12, so as to substantially deaden or eliminate any side attractive forces of magnet 12, so as to advantageously reduce or eliminate the possibility of magnet 12 attracting radially positioned objects which are not intended to be picked up with magnet 12. As set forth above, although high or low carbon, hardened or soft steels are suitable, it has been found that low carbon or very low carbon steel for sleeve 14 is very well suited for redirecting flux so as to induce another pole in front edge or ring 24 of sleeve 14 which serves to enhance the pick-up strength or force applied by magnet 12, which is advantageous in accordance with the present invention.

It has been found that sleeve member 14 may most preferably be provided having a wall thickness (t) sufficient to redirect substantially all radial flux from magnet 12. It has been found that suitable thickness of sleeve 14 can be related directly to the flux or power (P) of magnet 12 as follows. For a typical magnet, it has been found that for each 60–90 gauss of flux of magnet 12, approximately $1/1000$ of an inch of sleeve thickness is desirable. In other words, a ratio of thickness (t) to power (P) is preferably between about 0.001 in/90 gauss to about 0.001 in/60 gauss. This relation between sleeve thickness and magnet characteristics has been found for a typical magnet to advantageously provide a sleeve which economizes material and nevertheless provides the desired dampening of side pull and focusing of radial flux from magnet 12 toward edge 24 of sleeve member 14 as desired. Of course, this relation may vary depending upon the type and grade of magnet used.

Figure 2:
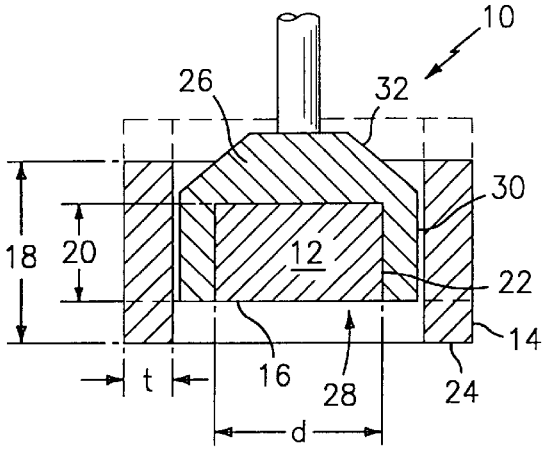
FIG. 2 is a cross-section of a magnetic head in accordance with the invention.

As set forth above, sleeve member 14 is held in the substantially centered position of FIG. 1 by magnetic force exerted by magnet 12. In accordance with the invention, sleeve 14 is slidable along axis A, in the direction of arrows X, against the magnetic bias of magnet 12. Referring also to FIG. 2, sleeve 14 is illustrated in the centered position, and, in dashed lines, in a rearwardly biased position wherein sleeve 14 has been biased against the force of magnet 12 to a position wherein pick-up surface 16 is more fully exposed for use in attracting and holding a ferrous or other magnetically attracted article. As set forth above, it should readily be apparent that upon removal of any such object, or other force biasing sleeve 14 against the force of magnet 12, that sleeve 14 will readily return to the substantially centered position of FIGS. 1 and 2.

Still referring to FIG. 2, an alternative embodiment of the invention is shown wherein magnet head 10 includes a magnet holder 26 having an interior well or opening 28 for receiving magnet 12, and having an exterior or peripheral surface 30 which surface is preferably substantially matched by sleeve 14 so that sleeve 14 is freely slidable along surface 30. In accordance with the invention, magnet holder 26 is preferably provided of a non-ferrous material such as, for example, aluminum, brass, plastic, non-magnetic stainless steel and the like. Holder 26 preferably freely transmits and does not interfere with flux from magnet 12 so that sleeve 14 can freely slide along holder 26 subject to the bias of magnet 12. As shown, magnet holder 26 preferably terminates toward pick-up surface 16 of magnet 12 in opening 28 as shown, and on an opposite side may suitably have shoulders 32 which are sloped inwardly toward axis A substantially as shown in FIG. 2. Shoulders 32 serve advantageously to guide sleeve 14 into a proper centered position with respect to magnet holder 26 and magnet 12 held thereby, especially if sleeve 14 is being biased from a position behind magnet holder 26 toward the centered position as desired. It should be noted that although holder 26 is disclosed in terms of a substantially cylindrical member, alternative structures could be provided, depending upon the shape of magnet 12. Further, alternative structure could be provided for positioning between magnet 12 and sleeve 14 as desired to provide for the free sliding nature of sleeve 14 relative to magnet 12 subject to magnetic force from magnet 12.

Figure 3:
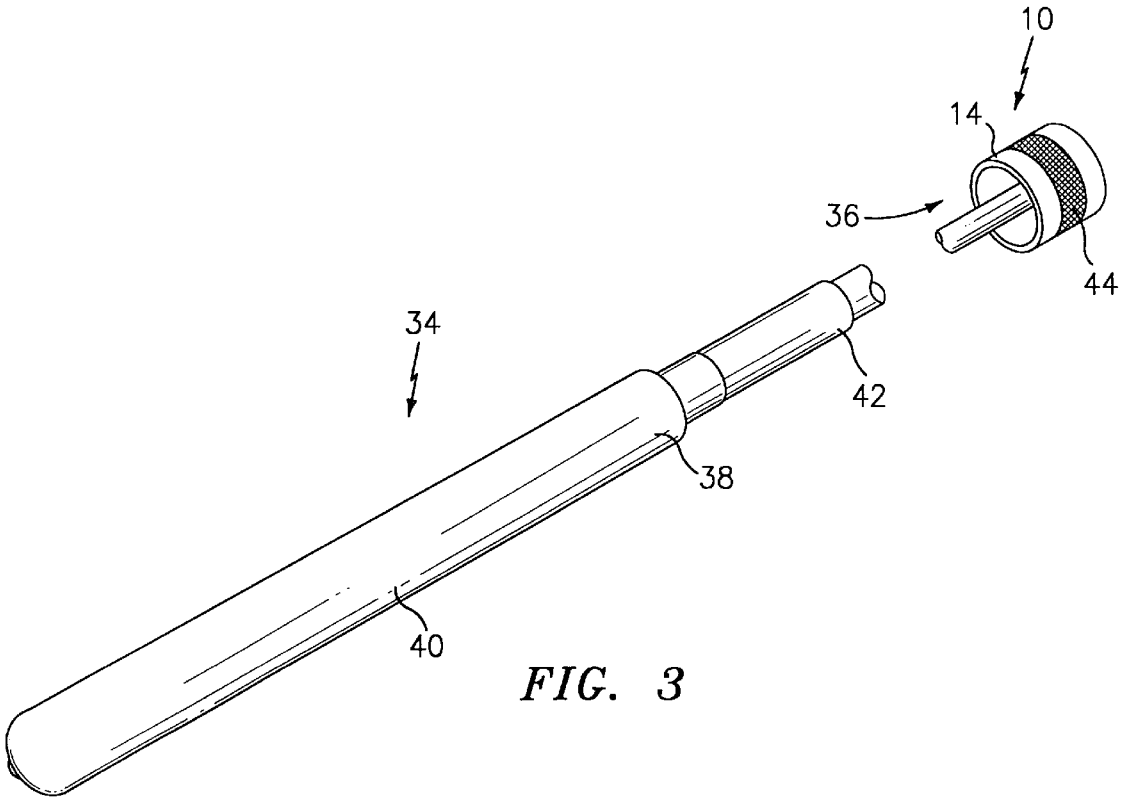
FIG. 3 is a perspective view a magnetic pick-up tool including a magnetic head in accordance with the present invention.

Referring now to FIG. 3, an application of magnet head 10 in accordance with the invention is illustrated. As set forth above, magnet head 10 may usefully be incorporated into a tool such as a pick-up tool having a magnet positioned at one end of a handle, preferably a substantially elongate device which can be used to retrieve magnetic objects from locations not easily reached by the person in question. FIG. 3 shows a magnetic pick-up tool 34 including magnetic head 10 in accordance with the invention attached at one end 36 of a substantially elongate handle member 38 which may be provided with a hand grip 40 as shown. Still further in accordance with this preferred embodiment, elongate handle member 38 includes a telescopic section 42 (partially broken away in FIG. 3) which can be used advantageously to provide for a longitudinally extendable tool for enhancing the reach of same. Any suitable extendable structure may be used in connection with handle member 38, and a telescopic section such as an antenna or the like has been found to be quite useful for same.

Alternatively, other structures may be provided for handle member 38, including but not limited to a simple rod, articulated members for pivot to fixed angle(s), flexible elongate structures, spring members and the like, and any other structure which enhances the use of the tool for a particular purpose.

Still referring to FIG. 3, sleeve member 14 may suitably be provided having a knurled, roughened or textured surface 44 positioned around at least a portion of the outer surface thereof. Surface 44 may serve in accordance with the present invention to provide better grip for manually moving sleeve 14 against the bias of magnet 12 as desired. Surface 44 may be provided in any desired ornamental pattern, such as an engraved diamond-like pattern and the like.

Figure 4:
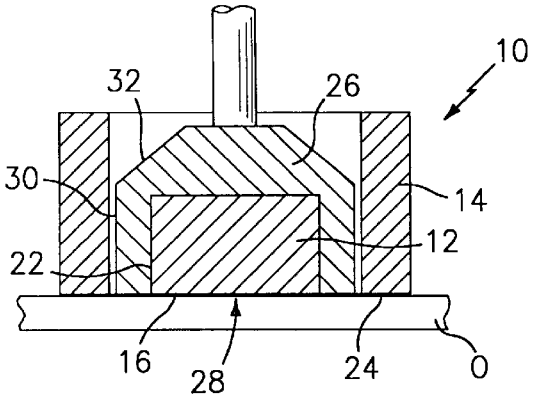
FIG. 4 is a cross-sectional view of a magnetic head in accordance with the present invention with an object held by the magnet.

Referring now to FIG. 4, magnet head 10 in accordance with the invention is shown in an operative position wherein sleeve 14 is deflected in a direction away from pick-up surface 16 along axis A so as to at least partially expose pick-up surface 16. As shown, an object (O) is held by pick-up surface 16 of magnet 12, and the force exerted upon object (O) is enhanced by the additional pull induced in edge 24 of sleeve 14 by radial flux from magnet 12. In an embodiment wherein pick-up surface 16 of magnet 12 is a North pole, sleeve 14 according to the invention advantageously provides another pole, oriented South, along edge 24 as described. For example, this orientation of poles in accordance with the invention has been found to provide a magnet head 10 having a typical magnet with a basic or normal force of attraction of approximately 4000 gauss with an additional pull of approximately 1200 gauss, which advantageously serves to increase the pulling power or force of magnetic head 10 in accordance with the present invention. As set forth above, once object (O) is retrieved and removed from magnetic head 10, sleeve 14 is returned by magnet 12 to the substantially centered or magnetically balanced rest position of FIGS. 1 and 2.

Figure 5:
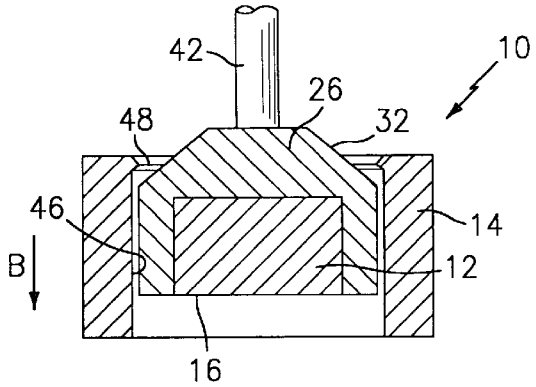
FIG. 5 is a side sectional view of a magnetic head in accordance with a further embodiment of the present invention.

Referring to FIG. 5, a further embodiment of the present invention is illustrated wherein sleeve 14 is provided with structure for holding sleeve 14 against complete removal from magnet 12 by engaging a back surface of magnet 12 or holder 26 such as shoulders 32. This serves advantageously to prevent removal and loss of sleeve 14. As shown, sleeve 14 preferably has an inner surface 46, and further includes a ridge 48 extending inwardly from inner surface 46 as shown. Ridge 48 preferably extends inwardly to a radius or circumference which is smaller in size than the exterior circumference of magnet 12 or, in the embodiment shown, of shoulders 32 of magnet holder 26. In accordance with this embodiment, and advantageously, ridge 48 serves to limit relative movement of sleeve 14 relative to magnet 12 in the "forward" direction represented by arrow B in FIG. 5 to a maximum forward position wherein ridge 48 engages shoulders 32 as desired.

It should of course be noted that although this embodiment is illustrated in FIG. 5 having an inwardly extending ridge 48, sleeve 14 could alternatively be provided with other inwardly extending structure arranged so as to contact against magnet 12 or some portion of holder 26 so as to act as a stop and thereby define a maximum forward position of sleeve 14 relative to magnet 12 as desired.

Figure 6:
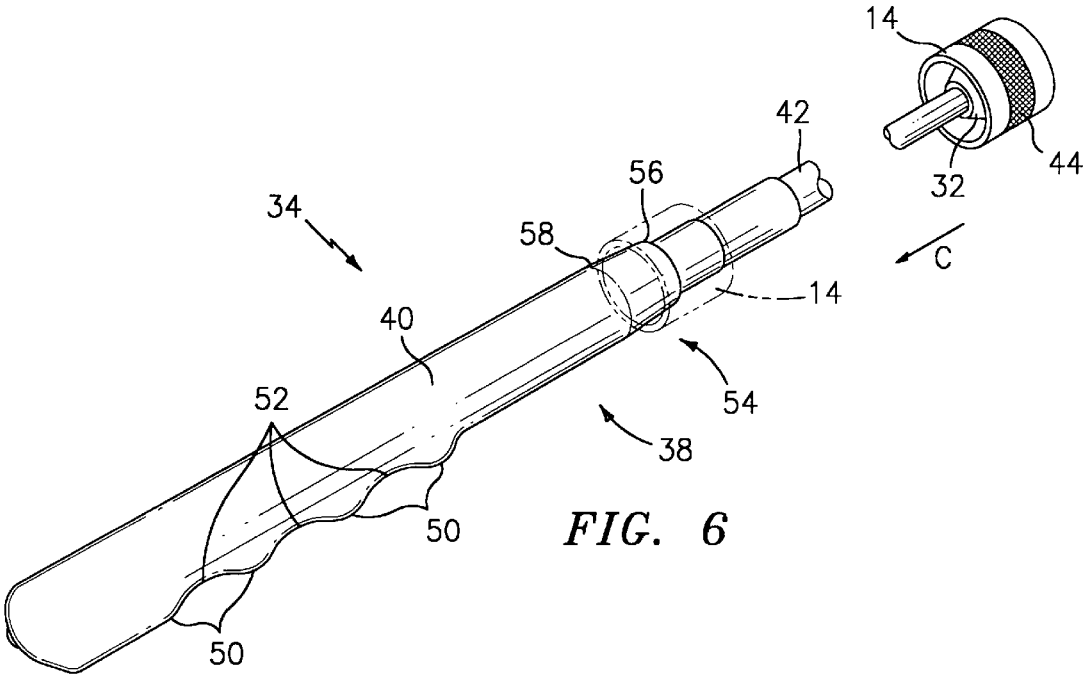
FIG. 6 is a perspective view of a magnetic pick-up tool in accordance with a further embodiment of the present invention.

Referring to FIG. 6, a further preferred embodiment of the invention is illustrated wherein handle member 38 is provided with a hand grip 40 having a series of extending members 50 arrange along one side of hand grip 40 so as to define indentations 52 therebetween which advantageously form a hand grip portion of handle member 38, thereby greatly facilitating the firm grasp and use of tool 34 in accordance with the present invention.

Still referring to FIG. 6, a further preferred embodiment of the present invention is illustrate wherein hand grip 40 terminates in a magnet facing end portion 54 which is substantially tapered so as to receive and frictionally engage sleeve 14, if desired. This feature of the present invention advantageously allows sleeve 14 to be rearwardly disposed relative to magnet 12 as shown by arrow C in FIG. 6 to a position completely removed from magnet 12, which may be desired for use of pick-up tool 34 in certain circumstances, and further serves to allow sleeve 14 to be held firmly in place on handle 40 during such use. In accordance with this embodiment of the invention, tapered end portion 54 of hand grip 40 is preferably a substantially conical or frustoconical shaped member defined by a forward facing small circumference 56 and a relatively rearward positioned large circumference 58 which define ends of the conical shape of portion 54. In accordance with the invention, the small circumference 56 is preferably sized so as to be smaller than an inner circumference of sleeve 14, while large circumference 58 is sized so as to be larger than the inner circumference of sleeve 14, whereby sleeve 14 will frictionally engage tapered portion 54 at some point between circumferences 56, 58.

Figure 7:
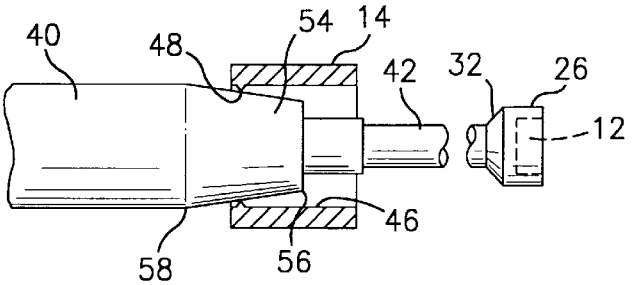
FIG. 7 is a side partially sectional view of a portion of the tool of FIG. 6.

FIG. 7 further illustrates this feature of the present invention in connection with the embodiment of FIG. 5 which includes ridge 48, and shows tapered portion 54 receiving sleeve 14 so as to allow magnet 12 to be used in a completely exposed condition. Ridge 48 advantageously serves to enhance the frictional engagement of sleeve 14 with tapered portion 54. It should readily be appreciated that after tool 34 has been used with magnet 12 in a completely exposed condition as desired, when it is desired to return sleeve 14 to a position around magnet 12 as shown for example in FIG. 5, sleeve 14 can be readily disengaged from portion 54 of hand grip 40 and disposed along telescopic section 42 to magnet 12 as desired.

In each of the above embodiments, it is preferred that sleeve 14 be provided substantially free of any structure which would close off or cover the open ends thereof, especially the open end through which pick-up surface 16 is exposed.

In accordance with the foregoing, it should be readily appreciated that sleeve 14 having open ends exposes pick-up surface 16 through one open end of sleeve 14 so as to advantageously allow pick-up surface 16 of magnet 12 to be used to magnetically secure certain objects as desired in accordance with present invention.

In accordance with the foregoing, it should readily be appreciated that a magnetic head and a magnetic pick-up tool including such head have been provided which readily accomplish each and every object of the present invention. Further, magnet head 10 of the present invention may suitably be incorporated into other tool structures as desired.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A magnet head for a magnetic pick-up tool, comprising:

a shaft;

a magnet having a pick-up surface and an opposed end, said shaft extending from said opposed end in a direction away from said pick-up surface; and a sleeve member having an open end and being slidably positioned over said magnet with said pick-up surface exposed through said open end, said sleeve member comprising a ferromagnetic material acted upon by said magnet such that said magnet exerts a force upon said sleeve for maintaining said sleeve in a rest position wherein said open end extends beyond said pick-up surface, wherein said sleeve is slidable relative to said magnet and said shaft in said direction away from said pick-up surface and against said force to a withdrawn position with respect to said magnet;

wherein said shaft includes a fixed shaft portion fixed relative to said magnet and extending in said direction from said opposed surface and out of said sleeve in said rest position.

2. A magnetic head according to claim 1, wherein said rest position is a substantially centered position of said sleeve with respect to said magnet.

3. A magnet head according to claim 1, wherein said rest position is a magnetically balanced position of said sleeve with respect to said magnet.

4. A magnet head according to claim 1, wherein said magnet has a longitudinal axis and wherein said sleeve is slidable relative to said magnet against said force along said axis.

5. A magnet head according to claim 1, wherein said sleeve is made of low carbon steel.

6. A magnet head according to claim 1, wherein said magnet is substantially cylindrical in shape, and wherein said sleeve is a substantially cylindrical sleeve.

7. A magnet head according to claim 6, wherein said cylindrical sleeve has two opposed open ends, and wherein said magnet head is substantially free of any structure closing said opposed open ends.

8. A magnet head according to claim 1, wherein said magnet has side surfaces and wherein said sleeve redirects flux from said side surfaces of said magnet whereby said magnet has substantially reduced side pull.

9. A magnet head according to claim 1, wherein said pick-up surface has a basic force of attraction, and wherein said magnet within said sleeve exerts an actual force at said pick-up surface which is greater than said basic force.

10. A magnet head according to claim 1, wherein said sleeve has a thickness sufficient to redirect substantially all radially directed flux from said magnet.

11. A magnet head according to claim 1, wherein said sleeve is positioned substantially freely slidable relative to said magnet.

12. A magnet head according to claim 1, wherein said sleeve has a leading edge, and wherein said magnet magnetizes said leading edge of said sleeve so as to enhance attractive forces of said magnet head.

13. A magnet head according to claim 1, wherein said magnet further includes a back surface opposite from said pick-up surface, wherein said sleeve is slidable relative to said magnet in a forward direction defined from said back surface toward said pick-up surface, and in a rearward direction defined from said pick-up surface toward said back surface, and wherein said sleeve further comprises means for engaging said back surface at a maximum forward position of said sleeve relative to said magnet whereby said sleeve is held against removal from said magnet in said forward direction.

14. A magnet head according to claim 13, wherein said means for engaging comprises an inwardly extending member connected to said sleeve to engage said back surface in said maximum forward position.

15. A magnet according to claim 14, wherein said sleeve has an inner surface, and wherein said inwardly extending member comprises a ridge extending inwardly from said inner surface.

16. A magnet head according to claim 1, wherein said means for moving extends from said opposite end of said magnet and out of said sleeve.

17. A magnet head according to claim 1, further comprising a holder attached to said shaft and having an outer surface and an open end for receiving said magnet, said sleeve member being slidably disposed around said outer surface.

18. A magnetic pick-up tool, comprising:

a handle member; and a magnet head attached to said handle member and comprising a magnet having a pick-up surface and an opposed surface in a direction away from said pick-up surface, said handle member extending from said opposed surface, and a sleeve member having an open end and being slidably positioned over said magnet with said pick-up surface exposed through said open end, said sleeve member comprising a ferromagnetic material acted upon by said magnet such that said magnet exerts a force upon said sleeve for maintaining said sleeve in a rest position wherein said open end extends beyond said pick-up surface, wherein said sleeve is slidable relative to said handle member and said magnet in said direction away from said pick-up surface and against said force to a withdrawn position with respect to said magnet, wherein said handle member includes a fixed shaft portion fixed relative to said magnet and extending in said direction from said opposed surface and out of said sleeve in said rest position.

19. A magnetic pick-up tool according to claim 18, wherein said handle member comprises a substantially elongate member.

20. A magnetic pick-up tool according to claim 18, wherein said handle member has an adjustable length.

21. A magnetic pick-up tool according to claim 18, wherein said magnetic head further comprises a holder attached to said handle member and having an outer surface and an open end for receiving said magnet, and wherein said sleeve member is slidably disposed around said outer surface.

22. A magnetic pick-up tool according to claim 18, wherein said magnet has a power (P), and wherein said sleeve has a wall thickness (t), and wherein a ratio of said thickness to said power is between about 0.001 in/90 gauss to about 0.001 in/60 gauss.

23. A magnetic pick-up tool according to claim 18, wherein said handle member further includes a sleeve receiving portion for frictionally holding said sleeve, whereby said sleeve can be withdrawn toward said handle member and removed from said magnet to said sleeve receiving portion of said handle.

24. A magnetic pick-up tool according to claim 23, wherein said sleeve receiving portion comprises a tapered portion of said handle member defined between a minimum circumference positioned relatively closer to said magnet head and a maximum circumference positioned relatively farther from said magnet head, and wherein said minimum circumference is smaller than an inner circumference of said sleeve and said maximum circumference is larger than said inner circumference.

25. A magnetic pick-up tool according to claim 18, wherein said handle member further includes a series of projections positioned so as to define a series of indentations along said handle.

26. A magnetic pick-up tool according to claim 18, wherein said means for moving extends from said opposite end of said magnet and out of said sleeve.

27. A magnet head for a magnetic pick-up tool, comprising:

a magnet having a pick-up surface and an opposed end;

a sleeve member having an open end and being slidably positioned over said magnet with said pick-up surface exposed through said open end, said sleeve member comprising a material selected from the group consisting of ferrous and ferromagnetic materials which is acted upon by said magnet such that said magnet exerts a force upon said sleeve for maintaining said sleeve in a rest position wherein said open end extends beyond said pick-up surface, wherein said sleeve is slidable relative to said magnet in a direction away from said pick-up surface and against said force to a withdrawn position with respect to said magnet; and shaft means fixed to said opposed end of said magnet, said shaft means including means for moving said magnet relative to said sleeve so as to position said sleeve in said withdrawn position.

28. A magnet head according to claim 27, wherein said means for moving extends from said opposite end of said magnet and out of said sleeve.

29. A magnet head for a magnetic pick-up tool, comprising:

a shaft;

a magnet having a pick-up surface and an opposed end, said shaft extending from said opposed end in a direction away from said pick-up surface; and a sleeve member having an open end and being slidably positioned over said magnet with said pick-up surface exposed through said open end, said sleeve member comprising a ferromagnetic material acted upon by said magnet such that said magnet exerts a force upon said sleeve form maintaining said sleeve in a rest position wherein said open end extends beyond said pick-up surface, wherein said sleeve is slidable relative to said magnet and said shaft in said direction away from said pick-up surface and against said force to a withdrawn position with respect to said magnet;

wherein said shaft includes means immovably fixed relative to said shaft and said magnet for moving said magnet relative to said sleeve so as to position said sleeve in said withdrawn position.

30. A magnetic pick-up tool, comprising:

a handle member; and a magnet head attached to said handle member and comprising a magnet having a pick-up surface and an opposed surface in a direction away from said pick-up surface, said handle member extending from said opposed surface in a direction away from said pick-up surface, and a sleeve member having an open end and being slidably positioned over said magnet with said pick-up surface exposed through said open end, said sleeve member comprising a ferromagnetic material acted upon by said magnet such that said magnet exerts a force upon said sleeve for maintaining said sleeve in a rest position wherein said open end extends beyond said pick-up surface, wherein said sleeve is slidable relative to said handle member and said magnet in said direction away from said pick-up surface and against said force to a withdrawn position with respect to said magnet, wherein said handle member includes means immovably fixed relative to said handle member and said magnet for moving said magnet relative to said sleeve so as to position said sleeve in said withdrawn position.

* * * * *

UNITED STATES PATENT AND TRADEMARK OFFICE

CERTIFICATE OF CORRECTION

PATENT NO. : 5,945,901

DATED : AUGUST 31, 1999

INVENTOR(S) : COLEMAN, JR. ET AL.

It is certified that error appears in the above-identified patent and that said Letters Patent is hereby corrected as shown below:

IN COLUMN 6, CLAIM 2, LINE 58, DELETE "MAGNETIC" AND INSERT --MAGNET--.

IN COLUMN 9, CLAIM 29, LINE 12, DELETE "FORM" AND INSERT --FOR--

Signed and Sealed this

Fourth Day of January, 2000

*Attest:*

*Attesting Officer*

*Acting Commissioner of Patents and Trademarks*